US010098449B2

(12) United States Patent
Chen

(10) Patent No.: US 10,098,449 B2
(45) Date of Patent: Oct. 16, 2018

(54) ROTARY ENGAGING ASSEMBLY

(71) Applicant: HANGZHOU DECHANG HARDWARE & FURNITURE CO., LTD, Zhejiang Province (CN)

(72) Inventor: Dechang Chen, Zhejiang Province (CN)

(73) Assignee: HANGZHOU DECHANG HARDWARE & FURNITURE CO., LTD, Zhejiang Province (CN)

( * ) Notice: Subject to any disclaimer, the term of this patent is extended or adjusted under 35 U.S.C. 154(b) by 612 days.

(21) Appl. No.: 14/830,254

(22) Filed: Aug. 19, 2015

(65) Prior Publication Data

US 2016/0106204 A1 Apr. 21, 2016

(30) Foreign Application Priority Data

Oct. 20, 2014 (CN) ..... 2014 2 0607308 U

(51) Int. Cl.
*A47B 3/08* (2006.01)

(52) U.S. Cl.
CPC ..... *A47B 3/08* (2013.01); *A47B 2200/0036* (2013.01); *A47B 2200/0043* (2013.01)

(58) Field of Classification Search
CPC . A47B 3/08; A47B 3/0815; A47B 2200/0036; A47B 2200/0043
See application file for complete search history.

(56) References Cited

U.S. PATENT DOCUMENTS

| | | | | |
|---|---|---|---|---|
| 7,703,400 | B2 * | 4/2010 | Mockel | A47B 3/0803 108/115 |
| 8,051,784 | B2 * | 11/2011 | Hsu | A47B 3/0815 108/115 |
| 8,051,785 | B2 * | 11/2011 | Lin | A47B 7/02 108/115 |
| 9,138,051 | B2 * | 9/2015 | Pan | A47B 41/02 |
| 2005/0235886 | A1 * | 10/2005 | Koning | A47B 3/0818 108/132 |
| 2007/0209559 | A1 * | 9/2007 | Mockel | A47B 3/0803 108/115 |

(Continued)

FOREIGN PATENT DOCUMENTS

CN 201290433 Y 8/2009

*Primary Examiner* — Matthieu F Setliff
(74) *Attorney, Agent, or Firm* — Muncy, Geissler, Olds & Lowe, P.C.

(57) ABSTRACT

A rotary engaging assembly includes a first fixed seat, a second fixed seat, a movable rotatable block, and an engaging block. The second fixed seat is fixedly connected with the first fixed seat and has a protruding portion facing the first fixed seat, and the protruding portion has an engaging block accommodating space. The movable rotatable block has a perforating hole and is sleeved on the protruding portion, and the movable rotatable block has a first groove and a second groove formed at an edge of the perforating hole. The engaging block is restricted within the engaging block accommodating space and movable within the engaging block accommodating space. The engaging block can be engaged with the first groove or the second groove, and the engaging block move within the engaging block accommodating space to be engaged or disengaged with the movable rotatable block.

6 Claims, 7 Drawing Sheets

(56) References Cited

U.S. PATENT DOCUMENTS

| | | | | |
|---|---|---|---|---|
| 2008/0178778 | A1* | 7/2008 | Koning | A47B 3/0818 108/132 |
| 2010/0071600 | A1* | 3/2010 | Lin | A47B 3/08 108/115 |
| 2016/0106204 | A1* | 4/2016 | Chen | A47B 3/08 403/117 |

* cited by examiner

ROTARY ENGAGING ASSEMBLY

CROSS-REFERENCE TO RELATED APPLICATIONS

This Non-provisional application claims priority under 35 U.S.C. § 119(a) on Patent Application No(s). 201420607308.8 filed in People's Republic of China on Oct. 20, 2014, the entire contents of which are hereby incorporated by reference.

BACKGROUND OF THE INVENTION

Field of the Invention

This invention relates to a folding table, and more particularly, relates to a rotary engaging assembly.

Description of the Related Art

At present, in order to make various tables meet the requirement for folding placement or adjustment of the angle of a table top, the table top generally needs to be turned over. This kind of table is generally called a turnover table, a collapsible table, or a folding table. Positioning pins are mainly used in the present engaging technique. However, a pull rod or a spanner is disposed externally when the above-mentioned technique is used. Chinese Utility Model Patent No. ZL200820135733.6 entitled "Folding Table Structure" discloses a novel rotary engaging assembly thus to conceal a locking structure inside a product. However, this technique has the shortcomings that the rotary engaging assembly is low in strength, easy to deform, inconvenient to operate and the like.

BRIEF SUMMARY OF THE INVENTION

This invention provides a novel rotary engaging assembly to realize convenient operation and improve mechanical strength of a product. The specific technical solution is as follows.

A rotary engaging assembly includes a first fixed seat, a second fixed seat, a movable rotatable block, and an engaging block. The second fixed seat is fixedly connected with the first fixed seat, the second fixed seat has a protruding portion facing the first fixed seat, and the protruding portion has an engaging block accommodating space. The movable rotatable block has a perforating hole and is sleeved on the protruding portion, and the movable rotatable block has a first groove and a second groove formed at an edge of the perforating hole. The engaging block is restricted within the engaging block accommodating space and movable within the engaging block accommodating space. The engaging block is capable of being engaged with the first groove or the second groove, and the engaging block move within the engaging block accommodating space to be engaged or disengaged with the movable rotatable block.

According to one embodiment of the invention, the rotary engaging assembly may further include a cylindrical control rod, a lifting rotating disc, a protruding block, a boss, and an elastic element. The engaging block may have a through groove, the cylindrical control rod may pass through the through groove, and the control rod may be disposed along an axis of the protruding portion and penetrate through circular holes of the first fixed seat and the second fixed seat. The lifting rotating disc may be disposed at the control rod, and the protruding block may be disposed at the engaging block corresponding to the lifting rotating disc. The boss may be disposed at another surface of the engaging block opposite to the protruding block, and the elastic element may be disposed between the boss and the control rod.

According to one embodiment of the invention, the lifting rotating disc may have a lowest edge and a highest edge, and are transition edges may be formed between the lowest edge and the highest edge. The engaging block may be engaged with the first groove or the second groove when the lowest edge rotates to the protruding block, and the engaging block may be disengaged from the first groove or the second groove when the highest edge rotates to the protruding block.

According to one embodiment of the invention, the elastic element may be a cylindrical spring.

According to one embodiment of the invention, the boss may have a groove or a convex column matched with the cylindrical spring, and one end of the cylindrical spring may be connected with a supporting block fitted to the cylindrical surface of the control rod.

By adopting the rotary engaging assembly in the invention, rotation is controlled by rotating the control rod, and both anticlockwise rotation and clockwise rotation can achieve the rotation, such that the rotation operation is much easier. Meanwhile, the thickness of the engaging block is not limited to the sizes of other assemblies, and the mechanical strength of a product is greatly improved.

These and other features, aspects, and advantages of the present invention will become better understood with regard to the following description, appended claims, and accompanying drawings.

DETAILED DESCRIPTION OF THE INVENTION

Figure 1:
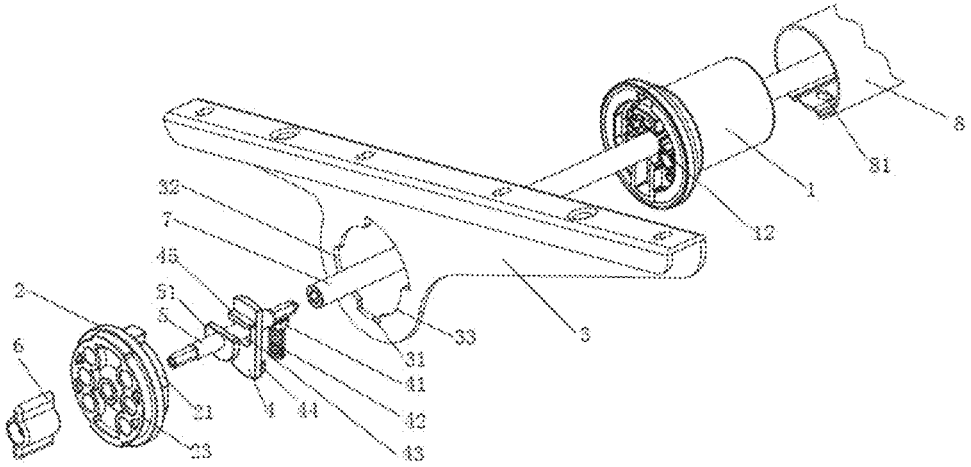
FIG. 1 is a schematic diagram showing an overall structure of a rotary engaging assembly in this invention.
Figure 2:
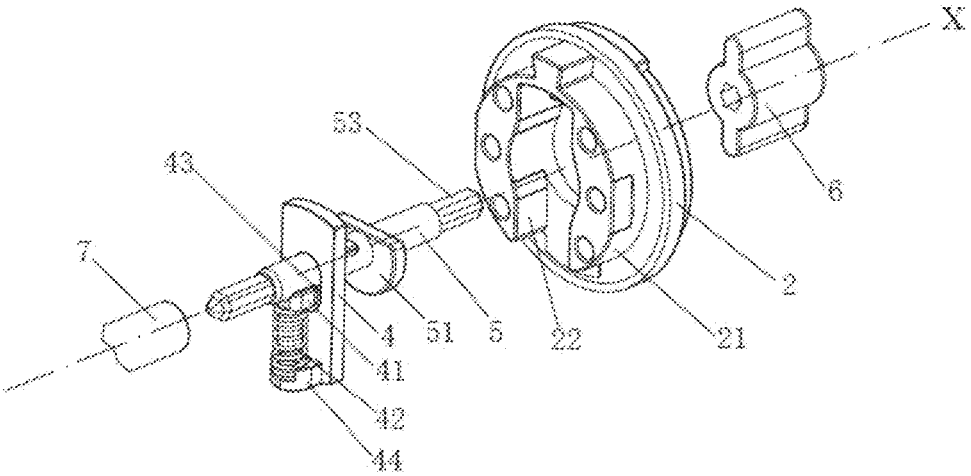
FIG. 2 is a schematic diagram showing a partial structure of the rotary engaging assembly.
Figure 3:
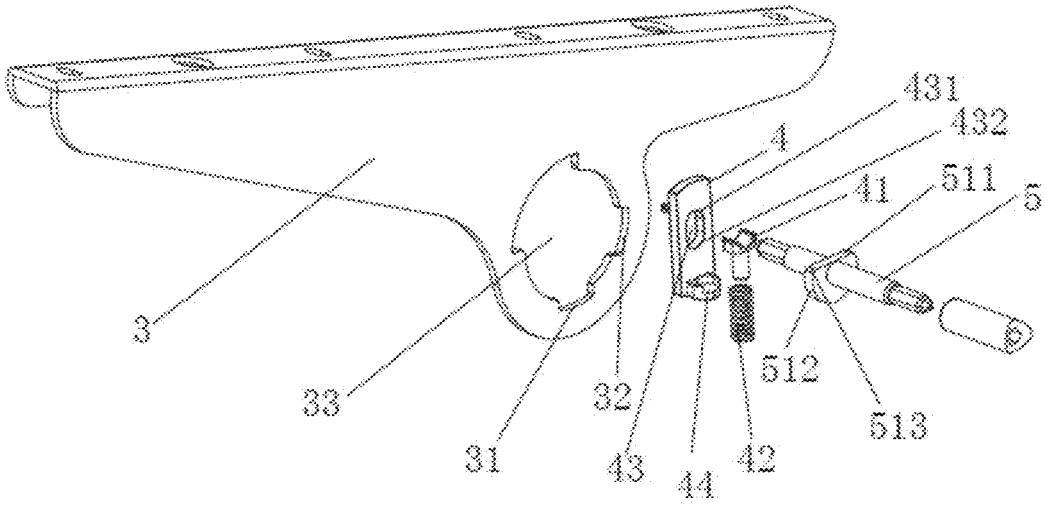
FIG. 3 is an exploded schematic diagram showing a partial structure of the rotary engaging assembly.

FIG. 1 is a schematic diagram showing an overall structure of a rotary engaging assembly in this invention. FIG. 2 is a schematic diagram showing a partial structure of the rotary engaging assembly. FIG. 3 is an exploded schematic diagram showing a partial structure of the rotary engaging assembly. Please refer to FIG. 1 to FIG. 3 together.

A rotary engaging assembly includes a first fixed seat 1, a second fixed seat 2, a movable rotatable block 3, and an engaging block 4. The second fixed seat 2 is fixedly connected with the first fixed seat 1. The second fixed seat 2 has a cylindrical protruding portion 21 facing the first fixed seat 1, and the protruding portion 21 has an engaging block accommodating space 22. After the second fixed seat 2 is fixedly connected with the first fixed seat 1, the protruding portion 21 is located between the first fixed seat 1 and the other parts of the second fixed seat 2.

The movable rotatable block 3 has a perforating hole 33 and is sleeved on the protruding portion 21, and the movable rotatable block 3 has a first groove 31 and a second groove 32 formed at an edge of the perforating hole 33.

The engaging block 4 is restricted within the engaging block accommodating space 22. In detail, the volume of the engaging block accommodating space 22 is larger than the volume of the engaging block 4 such that the engaging block 4 can move in the engaging block accommodating space 22, and the shape of the engaging block accommodating space 22 corresponds to the shape of the engaging block 4 such that the engaging block accommodating space 22 can restrict the engaging block 4 to only moving within the engaging block accommodating space 22 instead of rotating. Particularly, from the view of FIG. 2, the engaging block 4 can only move up and down and cannot rotate due to the restriction of the engaging block accommodating space 22.

The engaging block 4 is matched with the first groove 31 and the second groove 32 such that the engaging block 4 can be engaged with the first groove 31 or the second groove 32, and the engaging block 4 moves within the engaging block accommodating space 22 to be engaged or disengaged with the movable rotatable block 3.

In the embodiment, the rotary engaging assembly further includes a cylindrical control rod 5, a lifting rotating disc 51, a protruding block 45, a boss 44, and an elastic element 42. A through groove 43 is formed in the middle of the engaging block 4. The cylindrical control rod 5 passes through the through groove 43. In detail, the longitudinal section of the through groove 43 in this embodiment is in the shape of athletic track. That is, as shown in FIG. 3, the top 431 and the bottom 432 of the through groove 43 are arc-shaped, and the two lines connected with the top 431 and the bottom 432 are straight lines. However, the invention is not limited thereto. The distance between the top point and the bottom point in the longitudinal section of the through groove 43 is larger than the diameter of the control rod 5. Therefore, the control rod 5 can move and rotate in the through groove 43.

The ends of the control rod 5 may be manufactured into screw holes, studs, or hexagonal prisms, and are respectively matched and connected with a rotating element 6 and a connecting rod 7.

The control rod 5 is disposed along an axis X of the cylindrical protruding portion 21 and penetrates through a circular through hole 12 in the first fixed seat 1 and a circular through hole 23 in the second fixed seat 2. The lifting rotating disc 51 is disposed at the control rod 5. The protruding block 45 is disposed at the engaging block 4 corresponding to the lifting rotating disc 51. The boss 44 is disposed at another surface of the engaging block 4 opposite to the protruding block 45. The elastic element 42 is disposed between the boss 44 and the control rod 5. In the embodiment, the elastic element 42 can be a cylindrical spring.

In the embodiment, the boss 44 has a groove or a convex column matched with the cylindrical spring 42, and one end of the cylindrical spring 42 is connected with a supporting block 41 fitted to a cylindrical surface of the control rod 5. The other end of the cylindrical spring 42 is against the boss 44.

In the embodiment, the lifting rotating disc 51 is formed by cutting one end from a circular disc and processing the corners into arcs, so that the lifting rotating disc 51 has a lowest edge 511 and a highest edge 512, and arc transition edges 513 are formed between the lowest edge 511 and the highest edge 512. In this embodiment, the highest edge 512 refers to the whole circular edge.

When the lowest edge 511 is rotated to the protruding block 45, the engaging block 4 can be engaged with the first groove 31 or the second groove 32 under the action of outward thrust force of the cylindrical spring 42; and when the highest edge 512 is rotated to the protruding block 45, the engaging block 4 is lifted to be disengaged from the first groove 31 or the second groove 32. In this embodiment, the engaging block accommodating space 22 has an arc-shaped portion corresponding to the lifting rotating disc 51.

Figure 4A:
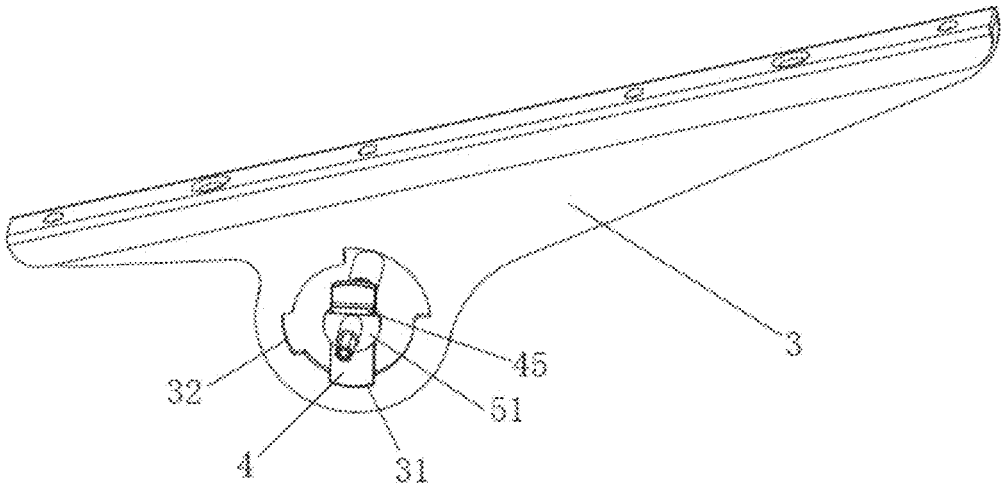
FIG. 4A is a schematic diagram showing an engaging state of the rotary engaging assembly according to one embodiment of the invention.
Figure 4B:
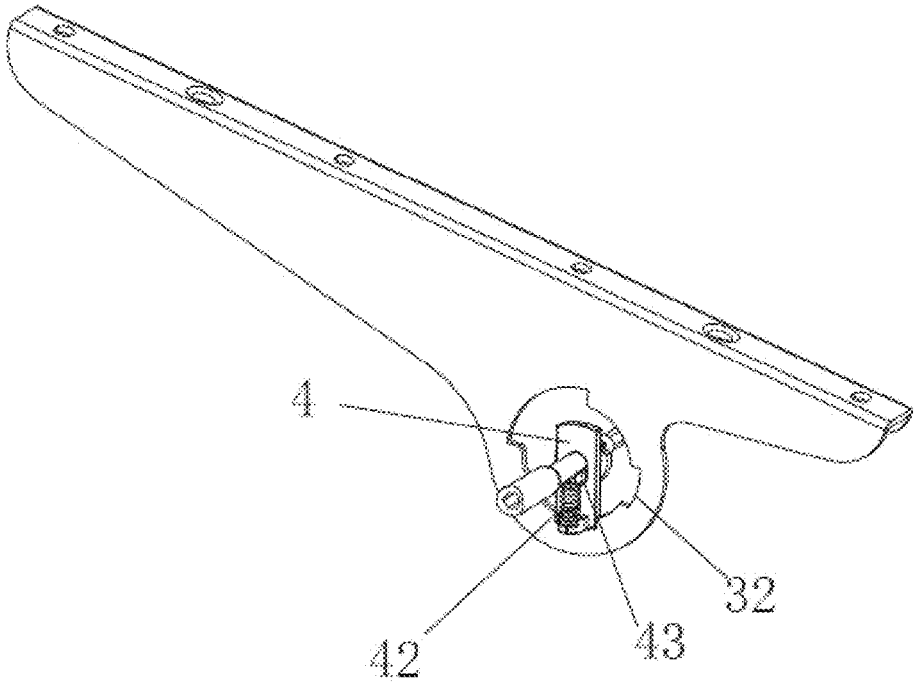
FIG. 4B is a schematic diagram showing the engaging state of the rotary engaging assembly as shown in FIG. 4A from another perspective.
Figure 5A:
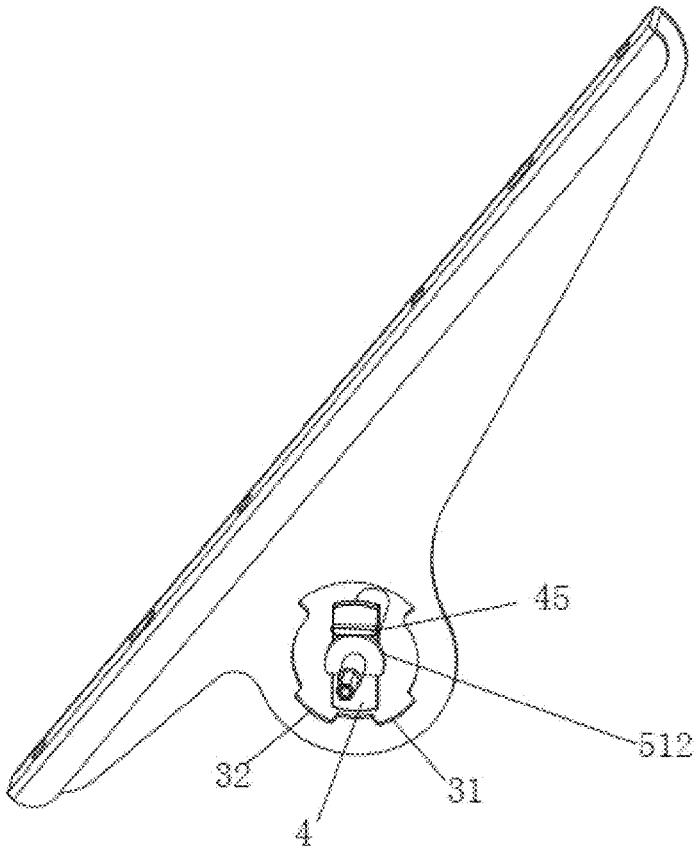
FIG. 5A is a schematic diagram showing a disengaging state of the rotary engaging assembly according to the embodiment of the invention.
Figure 5B:
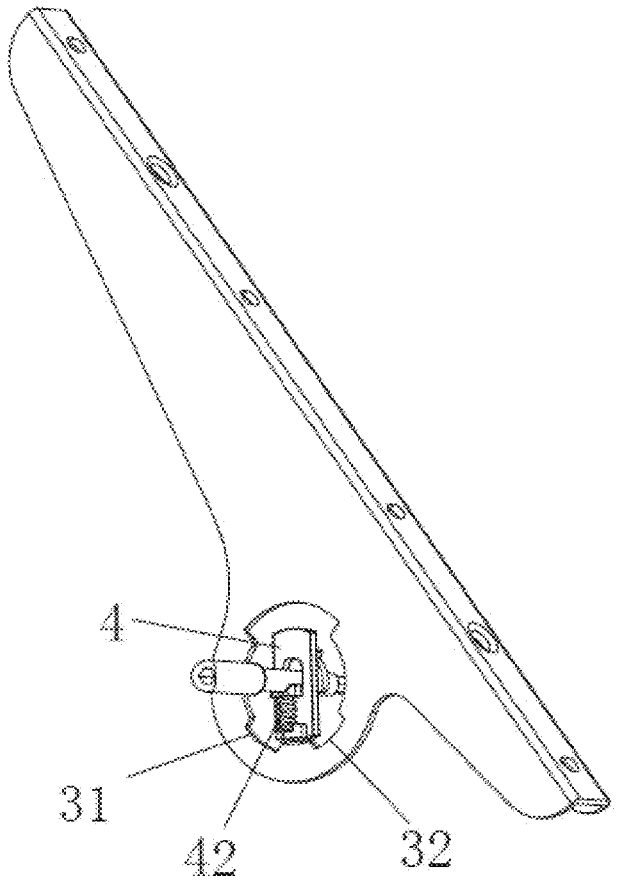
FIG. 5B is schematic diagram showing the disengaging state of the rotary engaging assembly as shown in FIG. 5A from another perspective.
Figure 6A:
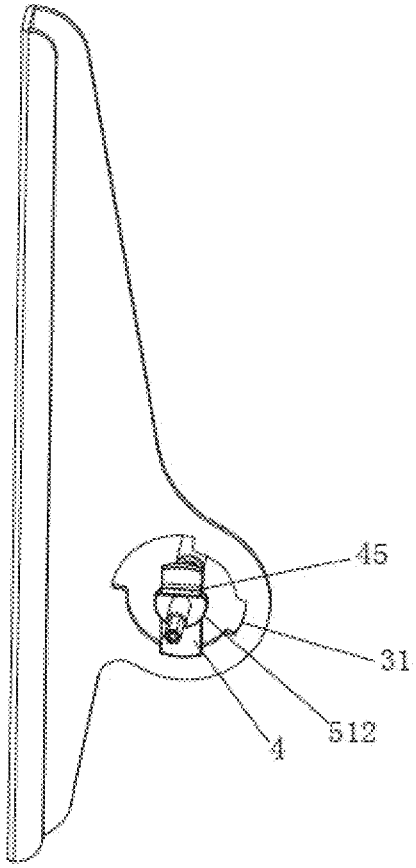
FIG. 6A is a schematic diagram showing another engaging state of the rotary engaging assembly according to the embodiment of the invention.
Figure 6B:
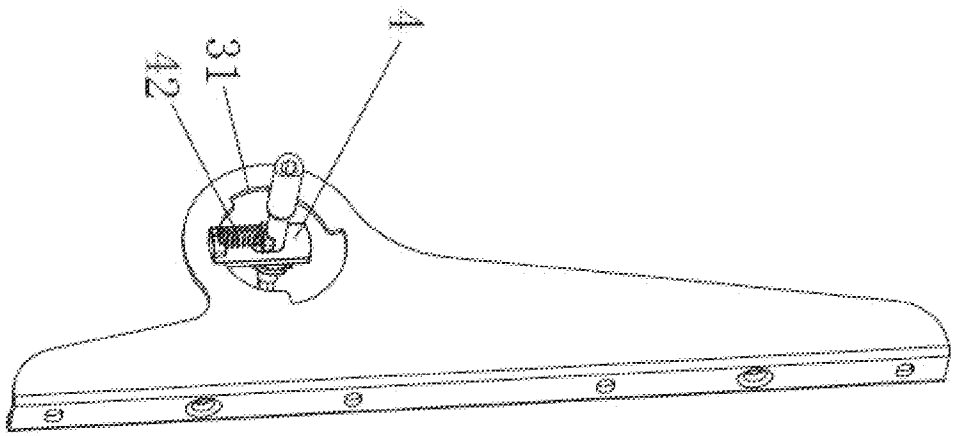
FIG. 6B is schematic diagram showing the engaging state of the rotary engaging assembly as shown in FIG. 6A from another perspective.

As shown in FIG. 4A and FIG. 4B, the engaging block 4 is engaged with the first groove 31. At that time, the lowest edge 511 of the lifting rotating disc 51 is against the protruding block 45, and the control rod 5 is against the top 431 of the through groove 43. The movable rotatable block 3 is in a horizontal state. Thus, a table top of a folding table is horizontal. If a user wants to rotate the table top, the user can rotate the rotating element 6 directly without exerting a pushing force to the rotating element 6. During the rotation, the highest edge 512 is rotated upwardly and toward the protruding block 45 (from the view of FIG. 5A and FIG. 5B). Since the highest edge 512 of the lifting rotating disc 51 comes into contact with the protruding block 45, the lifting rotating disc 51 exerts an upward force to the protruding block 45, and the protruding block 45 exerts a downward force to the lifting rotating disc 51 correspondingly. Then, the control rod 5 is moved away from the top 431 of the through groove 43 and moves to the bottom 432 of the through groove 43, the engaging block 4 is lifted away from the first groove 31, and the table top is rotated. At that time, the cylindrical spring 42 is compressed. Then, the user continues rotating. As shown in FIG. 6A and FIG. 6B, due to the extending force of the cylindrical spring 42, the engaging block 4 is moved to be engaged with the second groove 32. At that time, the table top is fixed at a rotated state.

If the user wants to rotate a conventional rotating structure, the user needs to push the rotating element at first to release the engaging state. Then the user needs to push the rotating element continually and to rotate the rotating element at the same time, which is quite inconvenient. During the rotation process, if the user relax the rotating element and does not exert a pushing force to the rotating element accidently, he cannot rotate successfully. However, according to the rotating locking assembly in the embodiment of the invention, the user can rotate the rotating element directly to rotate the table top. Further, the rotation direction is not limited. Both anticlockwise rotation and clockwise rotation can achieve the rotation. Therefore, the operation is more convenient and energy saving.

By adopting the rotary engaging assembly in the invention, rotation is controlled by rotating the control rod, and both anticlockwise rotation and clockwise rotation can achieve the rotation, such that the rotation operation is much easier. Meanwhile, the thickness of the engaging block is not limited to the sizes of other assemblies, and the mechanical strength of a product is greatly improved.

Although the present invention has been described in considerable detail with reference to certain preferred embodiments thereof, the disclosure is not for limiting the scope of the invention. Persons having ordinary skill in the art may make various modifications and changes without departing from the scope and spirit of the invention. Therefore, the scope of the appended claims should not be limited to the description of the preferred embodiments described above.

What is claimed is:

1. A rotary engaging assembly, comprising:

a first fixed seat;

a second fixed seat, fixedly connected with the first fixed seat, the second fixed seat having a cylindrical protruding portion facing the first fixed seat, the cylindrical protruding portion having an engaging block accommodating space;

a movable rotatable block, having a perforating hole and sleeved on the protruding portion, the movable rotatable block having a first groove and a second groove formed at an edge of the perforating hole;

an engaging block, restricted within the engaging block accommodating space and movable within the engaging block accommodating space, the engaging block capable of being engaged with the first groove or the second groove, the engaging block moving within the engaging block accommodating space to be engaged or disengaged with the movable rotatable block;

a cylindrical control rod;

a lifting rotating disc;

a protruding block;

a boss; and an elastic element;

wherein the engaging block accommodating space is formed by notching the cylindrical protruding portion, the engaging block has a through groove, the cylindrical control rod passes through the through groove, the control rod is disposed along an axis of the cylindrical protruding portion and penetrates through circular holes of the first fixed seat and the second fixed seat, the lifting rotating disc is disposed at the control rod, the protruding block is disposed at the engaging block corresponding to the lifting rotating disc, the boss is disposed at another surface of the engaging block opposite to the protruding block, and the elastic element is disposed between the boss and the control rod.

2. The rotary engaging assembly according to claim 1, wherein the lifting rotating disc has a lowest edge and a highest edge, arc transition edges are formed between the lowest edge and the highest edge, the engaging block is engaged with the first groove or the second groove when the lowest edge rotates to the protruding block, and the engaging block is lifted to be disengaged from the first groove or the second groove when the highest edge rotates to the protruding block.

3. The rotary engaging assembly according to claim 1, wherein the elastic element is a cylindrical spring.

4. The rotary engaging assembly according to claim 2, wherein the elastic element is a cylindrical spring.

5. The rotary engaging assembly according to claim 3, wherein the boss has a groove or a convex column matched with the cylindrical spring, and one end of the cylindrical spring is connected with a supporting block fitted to a cylindrical surface of the control rod.

6. The rotary engaging assembly according to claim 4, wherein the boss has a groove or a convex column matched with the cylindrical spring, and one end of the cylindrical spring is connected with a supporting block fitted to a cylindrical surface of the control rod.

* * * * *